US007218988B2

(12) United States Patent
Morita et al.

(10) Patent No.: US 7,218,988 B2
(45) Date of Patent: May 15, 2007

(54) YARN FEEDING APPARATUS OF WEFT KNITTING MACHINE

(75) Inventors: Toshiaki Morita, Wakayama (JP); Hirokazu Nishitani, Wakayama (JP); Masanori Inumaki, Wakayama (JP)

(73) Assignee: Shima Seiki Manufacturing Limited, Wakayama (JP)

( * ) Notice: Subject to any disclaimer, the term of this patent is extended or adjusted under 35 U.S.C. 154(b) by 0 days.

(21) Appl. No.: 10/576,024

(22) PCT Filed: Oct. 15, 2004

(86) PCT No.: PCT/JP2004/015247

§ 371 (c)(1),
(2), (4) Date: Apr. 17, 2006

(87) PCT Pub. No.: WO2005/038116

PCT Pub. Date: Apr. 28, 2005

(65) Prior Publication Data

US 2007/0000287 A1 Jan. 4, 2007

(30) Foreign Application Priority Data

Oct. 17, 2003 (JP) ..... 2003-358237

(51) Int. Cl.
*D04B 15/78* (2006.01)

(52) U.S. Cl. ..... 700/141; 66/71

(58) Field of Classification Search ..... 66/71, 66/77, 64, 54, 57; 700/141; 242/365.7, 242/418.1, 418

See application file for complete search history.

(56) References Cited

U.S. PATENT DOCUMENTS

| | | | | |
|---|---|---|---|---|
| 4,752,044 | A * | 6/1988 | Memminger et al. | 242/365.7 |
| 5,740,974 | A | 4/1998 | Conzelmann | |
| 6,010,052 | A | 1/2000 | Leins et al. | |
| 6,079,656 | A * | 6/2000 | Schmodde et al. | 242/365.7 |
| 6,170,301 | B1 * | 1/2001 | Stoll et al. | 66/126 R |
| 7,055,349 | B2 * | 6/2006 | Morita et al. | 66/146 |
| 2002/0139152 | A1 | 10/2002 | Nishitani | |

FOREIGN PATENT DOCUMENTS

| | | |
|---|---|---|
| JP | 57-191352 | 11/1982 |
| JP | 4-257352 | 9/1992 |
| JP | 6-316843 | 11/1994 |
| JP | 11-500500 | 1/1999 |
| JP | 2951068 | 9/1999 |
| JP | 2002-227064 | 8/2002 |

* cited by examiner

*Primary Examiner*—Danny Worrell
(74) *Attorney, Agent, or Firm*—Harness, Dickey & Pierce, P.L.C.

(57) ABSTRACT

A carriage which completes one course of knitting to the knitting end of a fabric is stopped. Knitting in a next course is performed when the carriage reverses its moving direction and re-starts its movement. Since the knitting yarn is not knitted to the fabric until a carrier brought by the carriage reaches a position of a knitting needle holding the stitch of the fabric at the knitting end, the knitting yarn existing in a feeding path between a yarn feeding mechanism and the carrier is excessively increased and a slack is generated. Since a distance between a yarn feeding port formed at a carrier's frontal end and the knitting needle at the fabric-knitting end is also reduced, the knitting yarn is further increased excessively. The further-excessively-increased knitting yarn is taken in by a yarn feeding means by reversing a servomotor, and further pulled in by a rewinding arm.

7 Claims, 8 Drawing Sheets

FIG. 8

| | KNITTING START | | DURING KNITTING | | KNITTING END | |
|---|---|---|---|---|---|---|
| | PROPORTION | INTEGRAL | PROPORTION | INTEGRAL | PROPORTION | INTEGRAL |
| FINGER | 3.0 | 1.0 | 1.0 | 5.0 | 2.0 | 1.0 |
| BODY | 3.0 | 1.0 | 2.0 | 1.0 | 1.0 | 1.0 |

YARN FEEDING APPARATUS OF WEFT KNITTING MACHINE

TECHNICAL FIELD

The present invention relates to a yarn feeding apparatus, of a weft knitting machine, capable of controlling a knitting yarn that is fed to a carrier for use in knitting a fabric such that the knitting yarn does not come loose even at a knitting end of the knitting fabric.

BACKGROUND ART

Conventionally, in weft knitting machines, a plurality of knitting needles are arranged side by side on needle beds, and a knitting fabric is knitted by feeding knitting yarns while a knitting operation is performed sequentially with the knitting needles. The sequential knitting operation of the knitting needles is performed by knitting cam mechanisms that are mounted on carriages moving along the needle beds. Carriers that are brought by the carriages feed knitting yarns to the knitting needles. The knitting yarns are fed to the carriers from a constant position along the needle beds such as the end portion or the central portion. While a knitting fabric is knitted, the relationship between the position of the carriages that bring the carriers and the position at which knitting yarns are fed continuously changes. Knitting yarns are knitted into the knitting fabric and consumed on the whole. However, when the carrier moves closer to the position at which the knitting yarn is fed, outside the knitting fabric, the feeding path of the knitting yarn to the carrier is shortened, but the knitting yarn of an amount by which the feeding path is shortened is not knitted into the knitting fabric, and thus the tensile force of the knitting yarn is reduced, so that the knitting yarn comes loose.

Generally, after knitting is performed up to an end of a knitting fabric of one course in movement from the position at which a knitting yarn is fed to the carrier to a side away from the position, the carriage continuously moves some distance, and is then halted. In order to knit the knitting fabric for the next one course, the movement direction of the carriage is reversed. When the carriage is reversed, starts to move in the opposite direction, and brings the carrier, the knitting yarn is not consumed until the carriage passes by the end portion of the knitting fabric and resumes the knitting of the knitting fabric. Even, when the distance from the position at which the knitting yarn is fed to the carrier to the carrier decreases and the knitting yarn of an amount by which the distance decreases is not necessary, the knitting yarn of the amount by which the feeding path is shortened cannot be knitted into the knitting fabric, and thus the tensile force of the knitting yarn is reduced, so that the knitting yarn comes loose. When a knitting fabric is knitted, it is required that a fluctuation in the tensile force of a knitting yarn is small. The tensile force of a knitting yarn affects the size of knitting loops of a knitting fabric that is to be knitted, and thus the fluctuation in the tensile force makes the size of knitting loops of the knitting fabric non-uniform.

In manual knitting machines in which the carriage is manually moved, an operation is performed using actuation in tension of a spring material (see Japanese Unexamined Patent Publication JP-A 57-191352 (1982), for example). In weft knitting machines of an automated control type in which a knitting fabric is knitted based on knitting data while driving the carriage, other methods also can be applied. A braking device and pulling back means are provided on a feeding path of a knitting yarn, and based on a start signal that is generated before the carriage actually starts to move, the braking device binds a knitting yarn and the pulling back means in which the torque is increased pulls back the knitting yarn. A technique for preventing the tensile force of a knitting yarn from being reduced in this manner by controlling the torque in every reversing movement of the carriage has been proposed (see Japanese Unexamined Patent Publication JP-A 04-257352 (1992), for example).

It should be noted that when the carriage moves in a direction away from the position at which a knitting yarn is fed to the carrier, the distance to the carrier increases as the carriage moves. Especially when the position at which a knitting yarn is fed to the carrier is provided on an end portion on one side on the needle bed, and the carriage is reversed from that end portion to the end portion on the other side, the demand for the knitting yarn drastically increases. The applicant of the invention has proposed a technique for suppressing a fluctuation in the tensile force of a knitting yarn by predicting the demand for a knitting yarn and by performing PID control on a servomotor for driving rollers by which a knitting yarn is held and sent out (see Japanese Unexamined Patent Publication JP-A 2002-227064, for example).

Simply by using tension of a spring material as in JP-A 57-191352, it is impossible to sufficiently perform the slack reduction that is necessary in order to knit a knitting fabric of a high quality by suppressing a fluctuation in the tensile force of a knitting yarn in a weft knitting machine in which the productivity is increased by moving the carriage at a high speed. In JP-A 04-257352, it is intended to reduce the slack by controlling the torque. In this case, when the tensile force of a knitting yarn increases because the knitting yarn is hooked at a midpoint on a feeding path, for example, it is impossible to pull in the knitting yarn any more.

When a knitting yarn is held and sent out by rollers as in JP-A 2002-227064, it is possible to cope with the drastic demand for a knitting yarn, but when the knitting yarn comes loose due to the change in the position of the carrier, the slack cannot be absorbed as appropriate. Thus, it is required that a knitting yarn does not come loose even when the demand for the knitting yarn vanishes.

DISCLOSURE OF INVENTION

It is an object of the invention to provide a yarn feeding apparatus of a weft knitting machine, capable of preventing as appropriate a knitting yarn from coming loose due to the change in the position of the carrier.

The invention is directed to a yarn feeding apparatus, of a weft knitting machine, for feeding a knitting yarn to a knitting fabric via a carrier that is brought by a carriage in the weft knitting machine in which a knitting fabric is knitted while moving the carriage back and forth in a longitudinal direction of a needle bed, comprising:

slack reducing means that is provided on a feeding path of the knitting yarn, whose actuation state can be controlled, and that can eliminate slack of the knitting yarn in an actuated state by pulling in the knitting yarn within a predetermined range, excess amount calculating means for calculating an excess amount of the knitting yarn that is generated in the knitting yarn on the feeding path when a movement direction of the carriage is reversed at a knitting end of the knitting fabric, based on a signal indicating knitting data of the knitting fabric with respect to a course that is to be knitted by moving the carriage and a signal for controlling the carriage, in accordance with a distance of the path on which the knitting yarn is fed to the carrier, a distance from the carrier to the knitting fabric, and a control state of the carriage, and control means for performing control such that slack of the knitting yarn is absorbed by actuating the slack reducing means in accordance with the excess amount that is calculated by the excess amount calculating means.

Furthermore, the invention is characterized by further comprising:

yarn feeding means that is provided on the feeding path of the knitting yarn, and that sends out the knitting yarn by holding the knitting yarn between a plurality of rollers including a yarn feeding roller that is rotatively driven by a servomotor, a buffer arm that is provided on the path on which the knitting yarn is fed from the yarn feeding means to the carrier, that can be swingingly displaced around a basal end side, and that is biased by a spring such that a frontal end side through which the knitting yarn is inserted is swingingly displaced and partially pulls the knitting yarn out of the path, and a sensor for detecting swinging displacement of the buffer arm, using as a reference an origin that is a position of the frontal end side when the knitting yarn is pulled out of the path only by the predetermined length, and for deriving a signal indicating a detection result, wherein the control means controls the servomotor of the yarn feeding means such that the knitting yarn that becomes necessary as the knitting fabric is knitted is sent out from the yarn feeding roller, based on the signal indicating the knitting data of the knitting fabric with respect to the course that is to be knitted by moving the carriage, the signal for controlling the carriage, and the signal from the sensor.

Furthermore, the invention is characterized in that the control means actuates the yarn feeding means as the slack reducing means by performing control such that the yarn feeding roller of the yarn feeding means is rotated in a direction opposite to a direction in which the knitting yarn is sent out.

Furthermore, the invention is characterized in that the path on which the knitting yarn is fed to the yarn feeding means is provided with a rewinding arm that can be swingingly displaced around a basal end side, that is biased by a spring such that a frontal end side through which the knitting yarn is inserted is swingingly displaced and partially pulls the knitting yarn out of the path, and that absorbs the knitting yarn that has been rewound to the path by rotating the yarn feeding roller in reverse.

Furthermore, the invention is characterized in that:

the slack reducing means is provided on the path on which the knitting yarn is fed from the yarn feeding means to the carrier, and the control means performs control such that the yarn feeding roller of the yarn feeding means is stopped before the slack reducing means is actuated.

Furthermore, the invention is characterized in that the slack reducing means includes:

a stepping motor that is controlled by the control means, and an arm having a basal end side mounted on a rotation axis of the stepping motor and a frontal end side through which the knitting yarn is inserted.

Furthermore, the invention is characterized in that the control means:

performs PI control on the servomotor of the yarn feeding means such that swinging displacement state of the buffer arm follows a target state that is set in advance based on positional relationship between the carriage and the knitting fabric, and changes an origin position that serves as a reference for a swinging displacement of the buffer arm when control is performed such that slack of the knitting yarn is absorbed by actuating the slack reducing means.

BRIEF DESCRIPTION OF DRAWINGS

Other and further objects, features, and advantages of the invention will be more explicit from the following detailed description taken with reference to the drawings wherein:

FIG. 8 is a table showing an example in which a control gain in PI control is set when a yarn feeding controller 9 in FIG. 1 controls a servomotor 22.

BEST MODE FOR CARRYING OUT THE INVENTION

Figure 1:
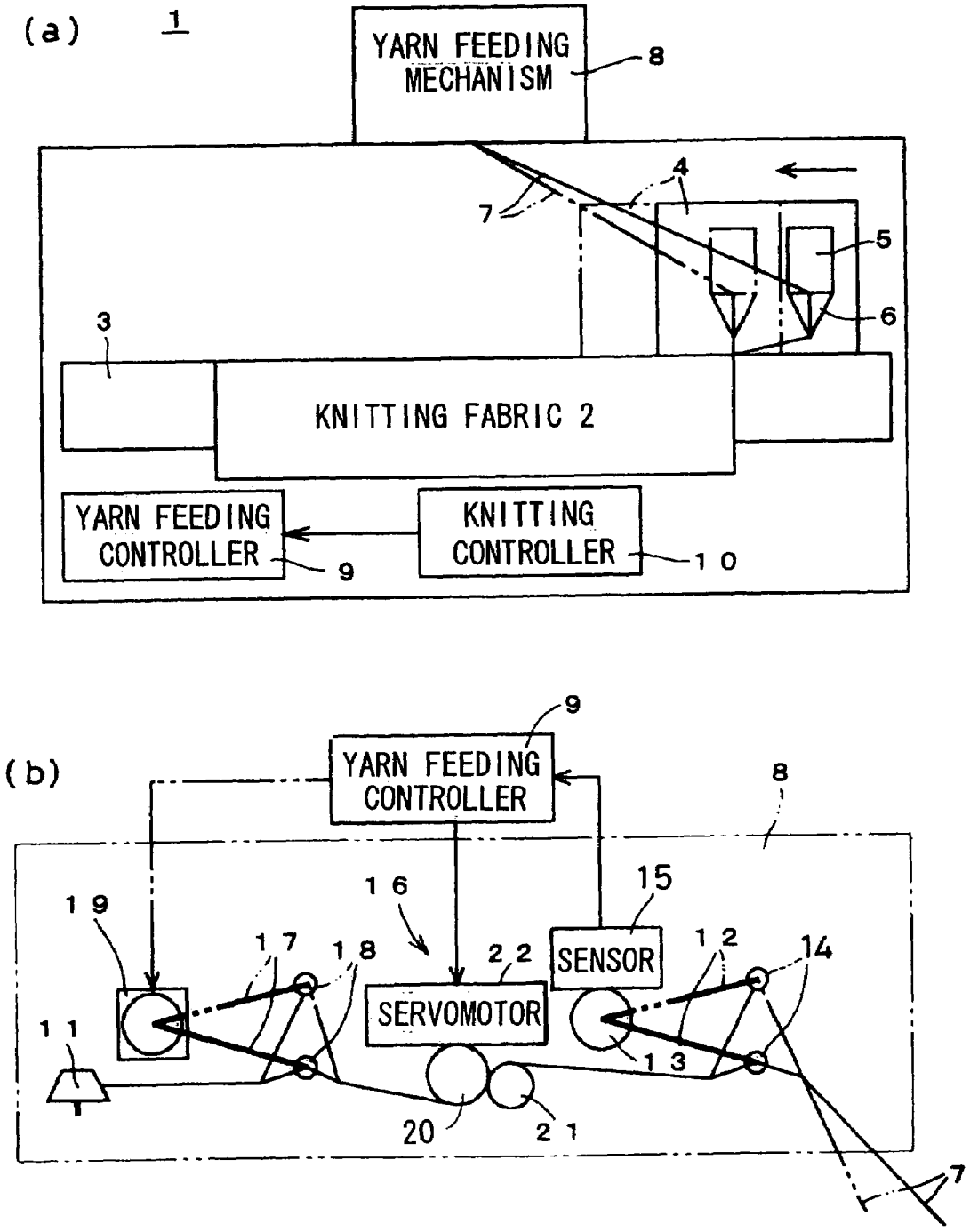
FIG. 1 shows a front view showing a schematic configuration of a weft knitting machine 1 provided with a yarn feeding apparatus according to an embodiment of the invention, and a view showing the configuration of the yarn feeding apparatus.

Now referring to the drawings, preferred embodiments of the invention are described below.

FIG. 1 shows a schematic configuration of a weft knitting machine 1 provided with a yarn feeding apparatus as an embodiment of the invention. FIG. 1(*a*) shows the overall configuration, and FIG. 1(*b*) shows the configuration relating to the yarn feeding apparatus.

As shown in FIG. 1(*a*), in the weft knitting machine 1, carriages 4 are moved back and forth in the longitudinal direction of needle beds 3 on which a large number of knitting needles are arranged side by side in order to knit a knitting fabric 2. The carriages 4 let the knitting needles perform a knitting operation with cam mechanism that are mounted on the carriages 4. The carriages 4 bring carriers 5 and feed knitting yarns 7 from yarn feeding ports 6 provided on the carriers 5 to the knitting needles. The knitting yarns 7 that are fed from the yarn feeding ports 6 to the knitting needles are fed from a yarn feeding mechanism 8 that is provided on the substantially central portion of the weft knitting machine 1 to the carriers 5. The yarn feeding mechanism 8 is controlled by a yarn feeding controller 9 and feeds the knitting yarns 7 while suppressing a fluctuation in the tensile force of the knitting yarns 7. A control signal of the carriages 4 is input from a knitting controller 10 for controlling the movement of the carriages 4 and the cam mechanisms based on knitting data of the knitting fabric 2, to the yarn feeding controller 9. Control in which the yarn feeding controller 9 sends out the knitting yarns 7 while the knitting fabric 2 is knitted is performed basically as in JP-A 2002-227064.

As shown in FIG. 1(*b*), the yarn feeding apparatus includes the yarn feeding mechanism 8 and the yarn feeding controller 9. A knitting yarn that is pulled out of a cone 11 that is the source of the knitting yarn 7 is fed by the yarn feeding mechanism 8 via a buffer arm 12 to the carrier 5. The buffer arm 12 includes a spring 13 and a frontal end ring 14. The frontal end ring 14 that is provided on the frontal end side of the buffer arm 12 faces a feeding path of the knitting yarn 7, and the knitting yarn 7 is inserted through the frontal end ring 14. A portion up to the frontal end ring 14 of the buffer arm 12 is swingingly displaced around the basal end side, and thus the knitting yarn 7 of some length can be stored. The buffer arm 12 is biased by the spring 13 to a direction in which the frontal end ring 14 moves away from the feeding path of the knitting yarn, and thus the buffer arm 12 is inclined to be balanced with the pulling force based on the tensile force of the knitting yarn 7. Swinging displacement of the buffer arm 12 detected as an angle by a sensor 15, and a signal indicating the detection result is input to the yarn feeding controller 9. A control signal of the carriage 4 from the knitting controller 10 and knitting data in order to knit the knitting fabric 2 are input to the yarn feeding controller 9. In order to knit the next course based on the control signal and the knitting data, the yarn feeding controller 9 performs control for suppressing a fluctuation in the tensile force of the knitting yarn 7 by suppressing a fluctuation in the inclination angle of the buffer arm 12. The control for keeping the tensile force of the knitting yarn 7 constant can be realized by actively sending the yarn in this manner. Furthermore, it is also possible to predict the demand for the knitting yarn 7 and to feed the knitting yarn 7 of a necessary length from the yarn feeding mechanism 8.

The yarn feeding means 16 is provided on the side of the cone 11 upstream of the buffer arm 12, on the feeding path of the knitting yarn 7. Furthermore, a rewinding arm 17 is provided between the yarn feeding means 16 and the cone 11. The rewinding arm 17 includes a frontal end ring 18 and a stepping motor 19. It is possible to adjust an amount of the knitting yarn 7 by which the knitting yarn 7 is pulled in by the rewinding arm 17, by controlling the stepping motor 19 from the yarn feeding controller 9.

It is also possible that the configuration of the rewinding arm 17 is similar to that of the buffer arm 12. It is also possible to reliably switch between actuation and non-actuation, by providing the rewinding arm 17 with a clutch and controlling the on/off of the actuation state from the yarn feeding controller 9. The yarn feeding means 16 holds the knitting yarn 7 between a main roller 20 and a sub roller 21 and sends out the knitting yarn 7 by driving the main roller 20 with a servomotor 22. The yarn feeding controller 9 controls the servomotor 22 such that the inclination angle of the buffer arm 12 that is detected by the sensor 15 follows the target value, and actively sends out the knitting yarn 7 from the yarn feeding rollers including the main roller 20 and the sub roller 21.

The carriage 4 that has ended the knitting of one course up to the knitting end of the knitting fabric 2 is stopped as indicated by the solid line. The next course is knitted when the movement direction of the carriage 4 is reversed and the movement is resumed. Until the carrier 5 that is brought by the carriage 4 has reached the position of the knitting needle holding a knitting stitch at the knitting end of the knitting fabric 2 as indicated by the dashed double dotted line and the knitting is resumed, the knitting yarn 7 is not knitted into the knitting fabric 2, and thus an excess amount of the knitting yarn is generated in the knitting yarn 7 that is present on the feeding path between the yarn feeding mechanism 8 and the carrier 5, so that the knitting yarn 7 comes loose. The distance between the yarn feeding port 6 that is provided at the frontal end of the carrier 5 and the knitting needle at the knitting end of the knitting fabric 2 decreases, and thus the knitting yarn 7 becomes further excessive. The excess amount, which is the length of the knitting yarn 7 that becomes excessive, can be calculated based on the position of the carrier 5. The yarn feeding controller 9 that functions also as excess amount calculating means also functions as control means for pulling in an excess amount of knitting yarn 7 by rotating the yarn feeding means 16 in reverse by rotating the servomotor 22 in reverse in accordance with the excess amount that is calculated in accordance with the position of the carrier 5. The excess amount of the knitting yarn 7 that is pulled in by the yarn feeding means 16 is retained between the yarn feeding means 16 and the yarn feeding mechanism 8. When the amount of the knitting yarn 7 that is retained becomes large, there is a possibility that the knitting yarn 7 moves off the knitting rollers including the main roller 20 and the sub roller 21 of the yarn feeding means 16. The rewinding arm 17 is provided between the yarn feeding means 16 and the yarn feeding mechanism 8, and thus it is possible to prevent the knitting yarn 7 from moving off the yarn feeding rollers by absorbing the knitting yarn 7 that is pulled in by rotating the yarn feeding means 16 in reverse.

Figure 2:
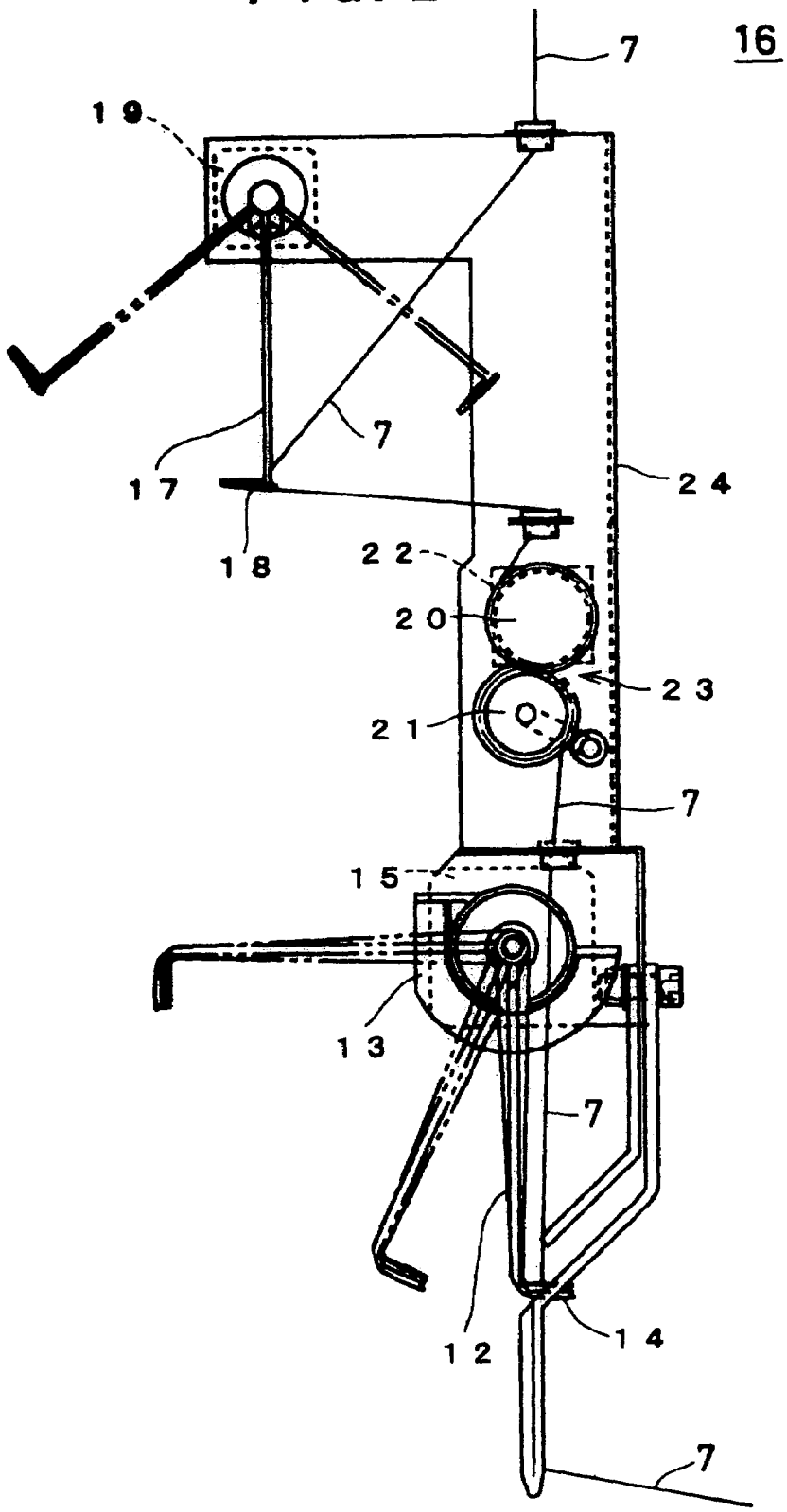
FIG. 2 is a front view showing the configuration of a buffer arm 12 and yarn feeding means 16, and a rewinding arm 17 in FIG. 1.
Figure 3:
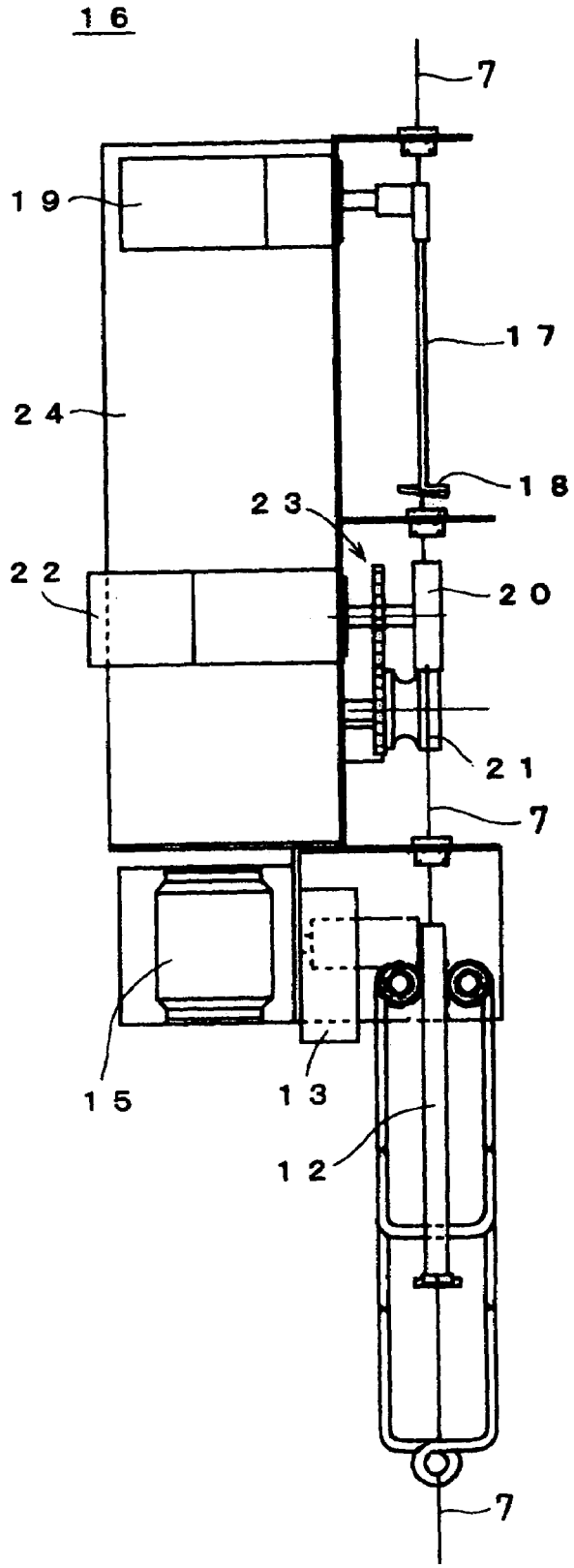
FIG. 3 is a left side view showing the configuration of the buffer arm 12 and the yarn feeding means 16, and the rewinding arm 17 in FIG. 1.
Figure 4:
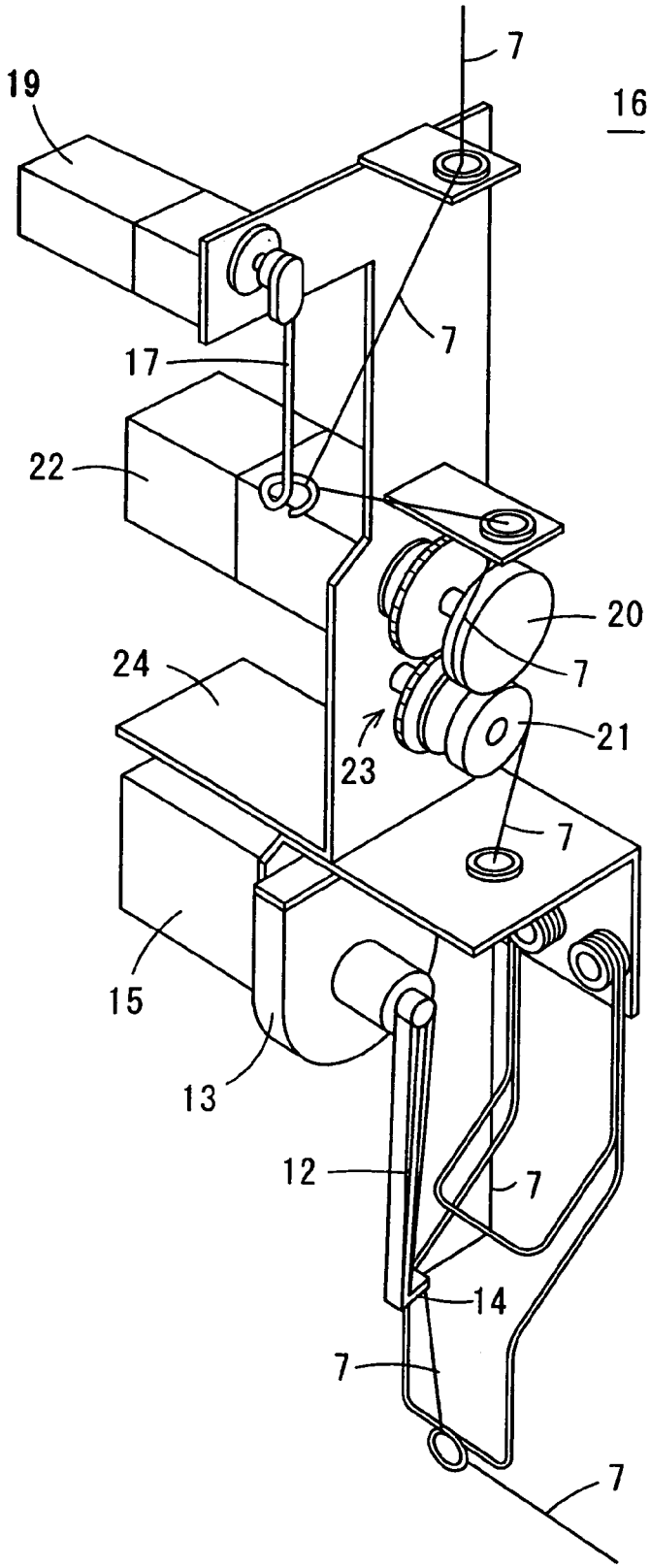
FIG. 4 is a perspective view showing the configuration of the buffer arm 12 and the yarn feeding means 16 in FIG. 1.

FIGS. 2, 3, and 4 show the configuration of the buffer arm 12 and the yarn feeding means 16, and the rewinding arm 17. FIG. 2 shows the front view, FIG. 3 shows the left side view, and FIG. 4 shows the perspective view. The yarn feeding means 16 has the main roller 20 and the sub roller 21 in order to feed the knitting yarn 7 to the buffer arm 12. The main roller 20 is mounted on a rotation axis of the servomotor 22, and the rotational force of the servomotor 22 is transmitted to the driven roller 21 via a driven mechanism 23 in which a plurality of gears are combined. The main roller 20 and the sub roller 21 are arranged so as to have the knitting yarn 7 interposed therebetween. The sub roller 21 is rotatively driven by the driven mechanism 23 at the circumferential speed equal to that of the main roller 20.

The knitting yarn 7 is fed from above a frame 24 and is guided to a portion in which the main roller 20 is opposed to the sub roller 21 while being in contact with the outer circumferential face of the main roller 20. There is a slight gap between the outer circumferential face of the main roller 20 and the outer circumferential face of the sub roller 21, and the knitting yarn 7 passes through the gap. The spring 13 for biasing to a direction in which the frontal end ring 14 pulls in the knitting yarn 7 is provided on the basal end side of the buffer arm 12. The buffer arm 12 is swingingly displaced by the spring 13 such that the inclination angle is small when the tensile force of the knitting yarn 7 is large and the inclination angle is large when the tensile force of the knitting yarn 7 is small. The inclination angle of the buffer arm 12 is detected by the sensor 15 that is provided on the basal end side. The buffer arm 12 is used in a range of 0° to 100°, for example.

Figure 5:
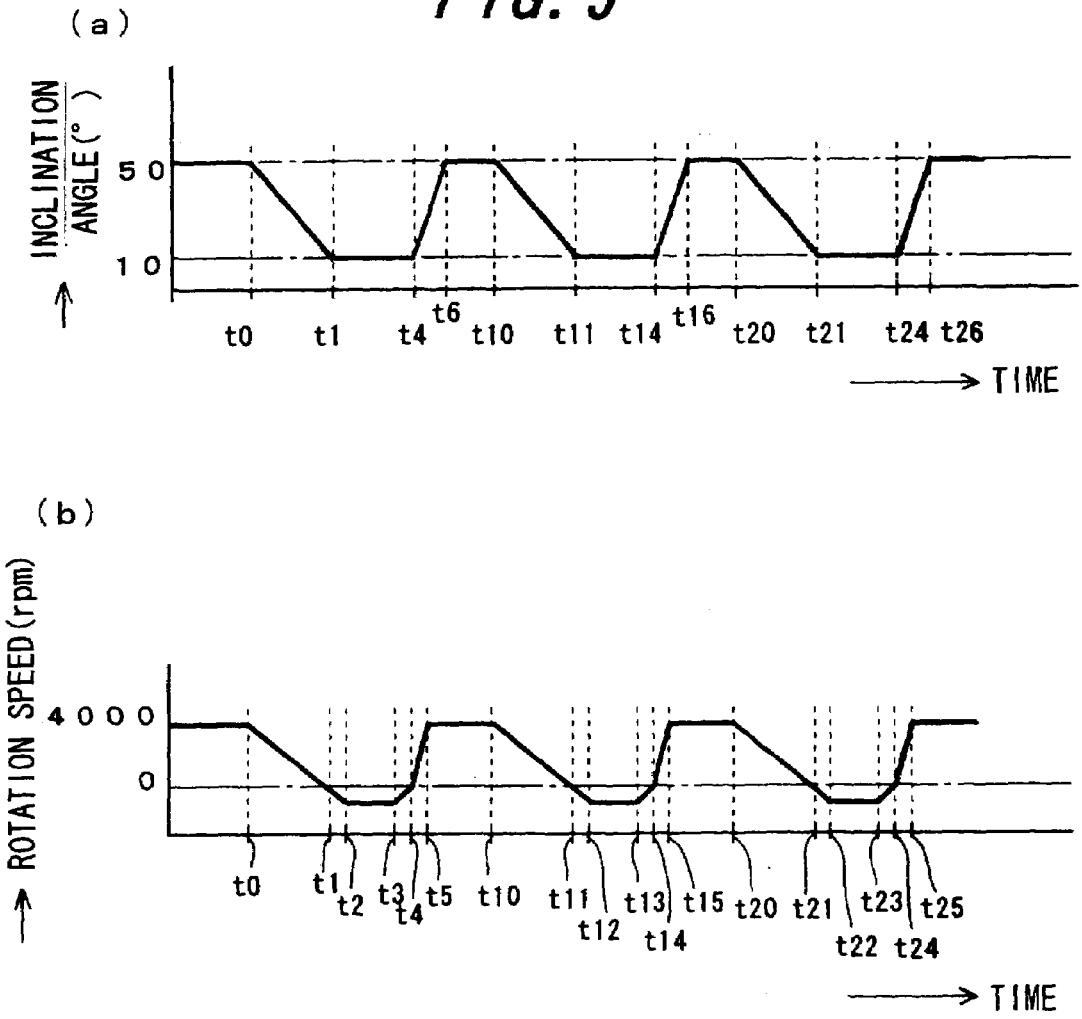
FIG. 5 shows time charts showing an outlined control state of a target value of an inclination angle of the buffer arm 12 and a rotation speed of a main roller 20 when a knitting fabric 2 is knitted in the weft knitting machine 1 in FIG. 1.

FIG. 5 shows an outlined control state of a target value of the inclination angle of the buffer arm 12 and a rotation speed of the main roller 20 when the knitting fabric 2 is knitted in the weft knitting machine 1 in FIG. 1. The target value of the inclination angle of the buffer arm 12 is set to, for example, 50° in the knitting, and it is made possible to cope with both an excess and a shortage of the knitting yarn 7 by keeping room for changes equivalently on the lower angle side where the inclination angle is 0° to 50° and on the higher angle side where the inclination angle is 50° to 100°. When the rewinding is performed in order to reduce the slack, the target value of the inclination angle is set to 10°. When the knitting yarn 7 is pulled in by rotating the servomotor 22 in reverse in order to reduce the slack, the pulling in of the knitting yarn 7 that has been stored at the buffer arm 12 is suppressed such that the loose knitting yarn 7 between the yarn feeding means 16 and the carrier 5 is efficiently pulled in. The switching of the setting between the two target values is performed as the switching of the origin position and a shifting period in which the target value continuously changes is provided therebetween. The inclination angle of the buffer arm 12 is determined based on the relationship between the biasing force of the spring 13 and the tensile force of the knitting yarn 7. It is possible to suppress the range in which the tensile force of the knitting yarn 7 fluctuates, by suppressing the range in which the inclination angle fluctuates.

It should be noted that in this embodiment, when the loose knitting yarn 7 is pulled in by rotating the servomotor 22 in reverse, the buffer arm 12 is inclined at 10° such that the knitting yarn 7 that has been stored at the buffer arm 12 is not pulled in. It is possible that the buffer arm 12 is not inclined but fixed with a stopper or other components in the vicinity of the target value 50° of the inclination angle of the buffer arm 12 in the knitting, for example, such that the buffer arm 12 does not swing.

In the weft knitting machine 1 in FIG. 1, the yarn feeding mechanism 8 is provided substantially in the center in the width direction of the knitting fabric 2. When the carriage 4 moves out of the knitting end of the knitting fabric 2 and is reversed, the distance between the carrier 5 that is brought by the carriage 4 and the yarn feeding mechanism 8 decreases. During this period, the knitting yarn 7 is not absorbed into the knitting fabric 2 in the knitting, and thus the knitting yarn 7 comes loose on both left and right sides in the drawing. Every time the carriage 4 performs knitting by moving back and forth on the knitting fabric 2 along the needle bed 3 and is reversed after passing by the knitting end of the knitting fabric 2, the knitting yarn 7 comes loose, and the yarn feeding controller 9 performs control for reducing the slack.

In FIG. 5, the knitting fabric 2 is knitted by repeating the course knitting by moving the carriage 4 back and forth. As an example, three successive courses started at time t0 are described. When a stitch cam of a knitting cam that is mounted on the carriage 4 in the knitting passes by the position of the knitting needle holding a knitting stitch at the knitting end of the knitting fabric 2 at times t0, t10, and t20, the knitting of the knitting fabric for one course is ended. Reversing control is started in order to knit the next course by reversing the travel direction of the carriage 4. FIG. 5(*a*) shows the change in the target value of the inclination angle of the buffer arm 12, and FIG. 5(*b*) shows the change in the rotation speed of the main roller 20 of the yarn feeding means 16. At times t0, t10, and t20, control is started in which the origin position of the inclination angle of the buffer arm 12 that is 50° in the knitting is switched to 10°, and the target value of the inclination angle is continuously changed to the changed origin position. The rotation speed of the main roller 20 is reduced from, for example, a sending state at a constant rotation speed of 4000 rpm. The setting is such that the target value of the inclination angle is 10° that is the origin on the lower angle side, and the rotation of the main roller 20 is in a stopping state when the carriage 4 is decelerated and stopped at times t1, t11, and t21.

In the periods from times t1, t11, and t21, the rewinding is performed, and the yarn feeding controller 9 controls the servomotor 22 such that the main roller 20 rotates in reverse. The main roller 20 is directly linked to an output shaft of the servomotor 22, and thus the servomotor 22 is rotated in the direction opposite to that in the knitting. Herein, it is not necessary that the rotation speed in the rewinding is very large. After the target rotation speed is reached at times t2, t12, and t22, the rotation speed is kept. It should be noted that it is also possible to change the rotation speed and the rotation direction of the main roller 20 by controlling a speed change mechanism, by providing the speed change mechanism instead of directly linking the servomotor 22 to the main roller 20.

At times t3, t13, and t23 immediately before the carrier 5 that is brought by the carriage 4 reversed after passing by the knitting end of the knitting fabric 2 reaches the knitting end, control is started in which the rotation speed of the servomotor 22 is returned to 0. At times t4, t14, and t24 at which the carrier 5 passes by the position of the knitting needle holding a knitting stitch at the knitting end of the knitting fabric 2 and moves into the knitting width range of the knitting fabric 2, the rotation speed of the servomotor 22 is returned to 0, and the knitting is started by increasing the rotation speed to the constant rotation speed in the knitting. At times t4, t14, and t24, change is started in which the origin of the inclination angle of the buffer arm 12 is switched to 50° on the higher angle side, and the target value of the inclination angle is continuously increased to the switched origin. At times t5, t15, and t25, the rotation speed of the servomotor 22 reaches the constant rotation speed in the knitting, and at times t6, t16, and t26, the target value of the inclination angle of the buffer arm 12 reaches 50° that is the origin position on the higher angle side. Subsequently, the constant control state is kept up to the knitting end of the knitting fabric 2.

Figure 6:
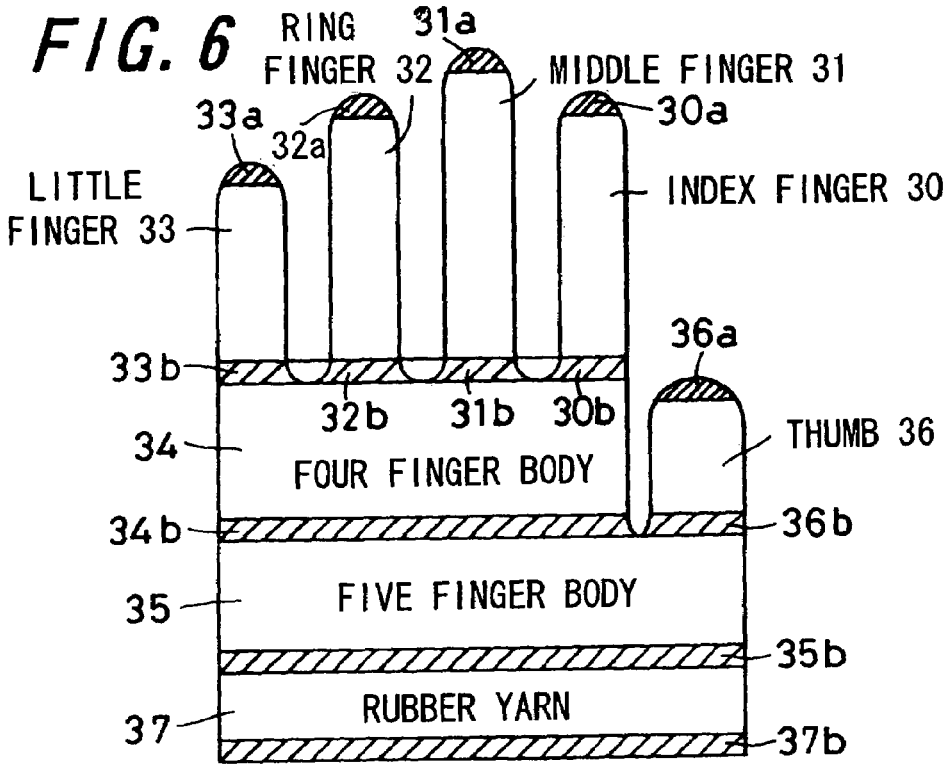
FIG. 6 is a view showing a schematic configuration of a glove that is one example of the knitting fabric 2 that is knitted in the weft knitting machine 1 in FIG. 1.

FIG. 6 shows a schematic configuration of a glove that is one example of the knitting fabric 2 that is knitted in the weft knitting machine 1 in FIG. 1. In the glove, portions accommodating four fingers are each by each knitted with tubular plain stitch as an index finger 30, a middle finger 31, a ring finger 32, and a little finger 33, and a portion accommodating a palm portion that is a base for the four fingers is knitted with tubular plain stitch as a four finger body 34. A portion accommodating the entire palm is knitted with tubular plain stitch as a five finger body 35. The five finger body 35 is knitted as one tubular plain stitch portion by knitting a thumb 36 with tubular plain stitch separately from the four finger body 34, and connecting the four finger body 34 and the thumb 36. After the five finger body 35, a rubber yarn portion 37 that spans over a wrist portion is knitted using an elastic yarn. The knitting with an elastic yarn is performed using the yarn knitting mechanism 8 and the carrier 5 different from those for other knitting yarns 7. The weft knitting machine 1 is provided with a plurality of sets of yarn feeding mechanism 8 and the carrier 5, and when the carrier 5 that is brought by the carriage 4 is selected, it is possible to switch the knitting yarns 7 used for knitting, including an elastic yarn and the like. Furthermore, a tubular plain stitch portion can be knitted by using the pair of needle beds 3 such that the needle beds 3 face each other at the tooth portion and the knitting yarns 7 move from one needle bed to the other needle bed at the knitting end of the knitting fabric 2 that is being knitted on the needle beds 3.

Hatched portions such as finger tips 30*a*, 31*a*, 32*a*, 33*a*, and 36*a* and finger forks 30*b*, 31*b*, 32*b*, 33*b*, and 36*b* in the knitting fabric of the glove are knitted slightly reducing the movement speed of the carriage 4 without switching the origin position of the buffer arm 12 as shown in FIG. 5(*a*). An ending portion 34*b* of the four finger body 34 corresponding to the finger fork 36*b* of the thumb 36, an ending portion 35*b* of the five finger body 35 shifting from the five finger body 35 to the rubber yarn portion 37, and an ending portion 37*b* of the yarn rubber portion 37 are knitted slightly reducing the movement speed of the carriage 4 without switching the origin position of the buffer arm 12.

Figure 7:
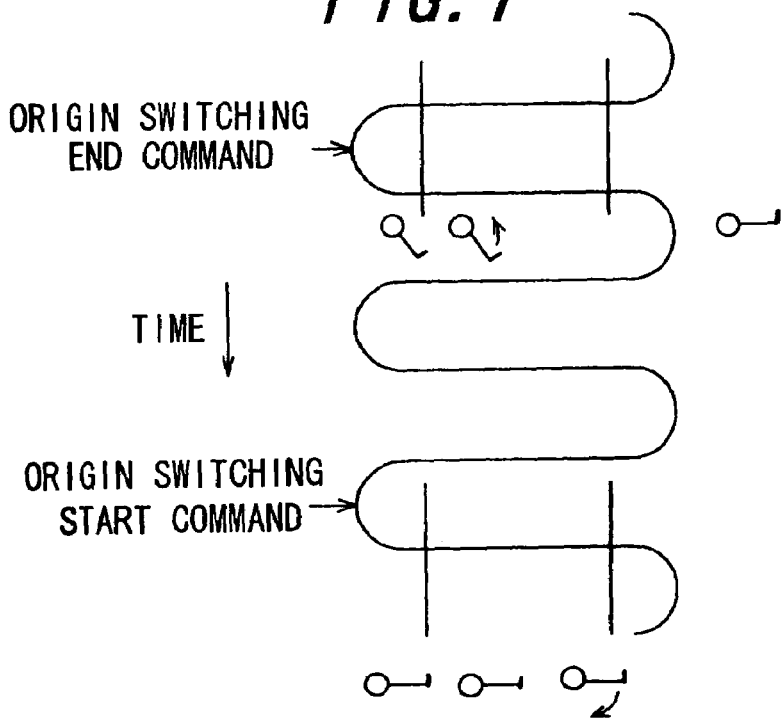
FIG. 7 is a view showing a switching state of control, with respect to a portion processed when the process is shifted to control in which the origin position of the buffer arm 12 is switched after a portion that is knitted by slightly reducing the movement speed of a carriage 4 is knitted without switching the origin position in FIG. 6.

FIG. 7 shows a switching state of the control, with respect to a portion processed when the process is shifted to control in which the origin position of the buffer arm 12 is switched after a portion that is knitted by slightly reducing the movement speed of the carriage 4 is knitted without switching the origin position in FIG. 6. When a portion in which the origin position is not switched is knitted, an origin switching end signal is given based on knitting data. When an origin switching end signal is given, the origin position of the buffer arm 12 stays at 50° in the knitting. When a period in which the origin position is not switched ends, an origin switching start signal is given, the origin position of the buffer arm 12 is set to 10° on the lower angle side during a process in which the carriage 4 is reversed and advances onto the knitting fabric 2. When the knitting of the knitting fabric 2 is started, the origin position is switched to 50°.

FIG. 8 shows an example in which a control gain is set when PI control is performed combining proportion (P) and integral (I) such that the knitting yarn controller 9 in FIG. 1 controls the servomotor 22. In a case where the knitting fabric 2 is a glove as shown in FIG. 6, a control gain is set separately for a finger portion and for a body portion. Portions of "knitting start" correspond to periods from times t4, t14, and t24 to times t6, t16, and t26 in FIG. 5. Portions of "during knitting" correspond to periods from times t6, t16, and t26 to times t10 and t20 in FIG. 5. Portions of "knitting end" correspond to periods from times t0, t10, and t20 to times t4, t14, and t24 in FIG. 5. As a general inclination of the control gain, proportion is made larger than integral. However, integral is made larger than proportion during knitting.

Figure 9:
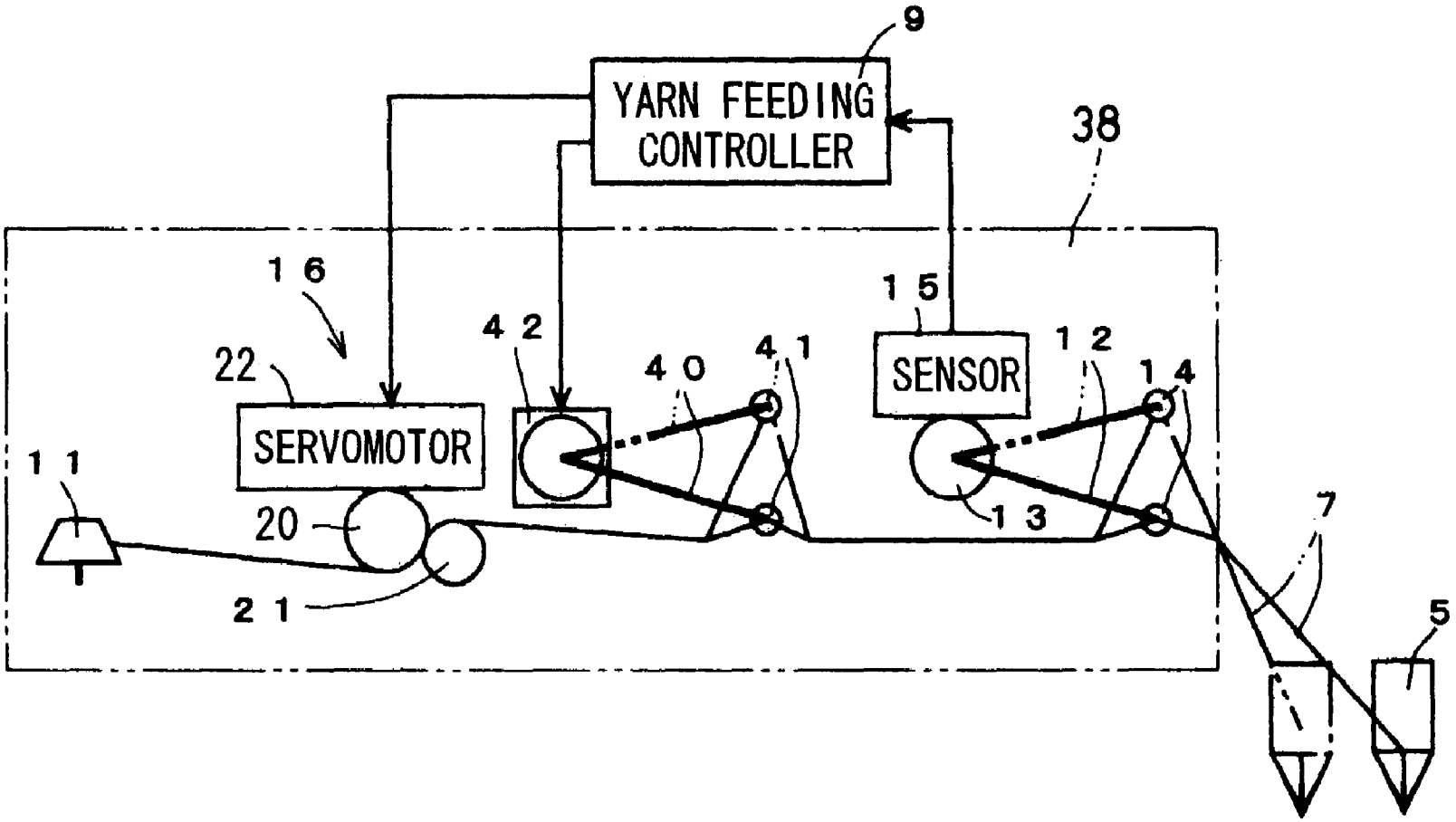
FIG. 9 is a view showing a schematic configuration of a yarn feeding mechanism 38 according to another embodiment of the invention.

FIG. 9 shows a schematic configuration of a yarn feeding mechanism 38 as another embodiment of the invention. The yarn feeding mechanism 38 can be used as the yarn feeding mechanism 8 shown in FIG. 1(*b*), the corresponding components are denoted by the same reference symbols and the repeated description thereof has been omitted. In the yarn feeding mechanism 38, instead of slack reducing means including the rewinding arm 17, the frontal end ring 18, and the stepping motor 19 of the yarn feeding mechanism 8, slack reducing means including a slack reducing arm 40, a frontal end ring 41, and a stepping motor 42 is provided between the yarn feeding means 16 and the buffer arm 12. The stepping motor 42 can be controlled by the yarn feeding controller 9 as the stepping motor 19 described above. It is also possible to provide the slack reducing arm 40, the frontal end ring 41, and the stepping motor 42 on the side of the carrier 5 with respect to the buffer arm 12.

The slack reducing arm 40 as the slack reducing means is provided on the path on which the knitting yarn 7 is fed from the yarn feeding means 16 to the carrier 5. The yarn feeding controller 9, which is control means, performs control in which the servomotor 22 is stopped such that the main roller 20, which is a yarn feeding roller of the yarn feeding means 16, is stopped before the stepping motor 42 of the slack reducing arm 40 is actuated. The knitting yarn 7 is not newly fed from the yarn feeding means 16. The slack generated in the knitting yarn 7 that is present on the feeding path between the main roller 20 and the carrier 5 can be absorbed by actuating the stepping motor 42.

As described above, according to the embodiments, the yarn feeding apparatus includes the yarn feeding means 16, the buffer arm 12, the sensor 15, the slack reducing means, and the control means in order to feed the knitting yarn 7 to the knitting fabric 2 via the carrier 5 that is brought by the carriage 4 in the weft knitting machine 1 in which the knitting fabric 2 is knitted while moving the carriage 4 back and forth in the longitudinal direction of the needle bed 3. The yarn feeding means 16 is provided on the feeding path of the knitting yarn 7, and sends out the knitting yarn 7 by holding the knitting yarn 7 between a plurality of rollers including the main roller 20, which is a yarn feeding roller that is rotatively driven by the servomotor 22. The sending out of the knitting yarn 7 can be promptly controlled by controlling the main roller 20 based on, for example, the control of the servomotor 22. The buffer arm 12 is provided on the path on which the knitting yarn 7 is fed from the yarn feeding means 16 to the carrier 5, can be swingingly displaced around the basal end side, and the frontal end side provided with the frontal end ring 14 through which the knitting yarn 7 is inserted is swingingly displaced. The buffer arm 12 is biased by a spring so as to partially pull the knitting yarn 7 out of the path, and thus when the tensile force of the knitting yarn 7 becomes small, an amount by which the buffer arm 12 is swingingly displaced increases, and thus the length of the knitting yarn 7 that is pulled out of the path becomes long. When the tensile force of the knitting yarn 7 becomes large, an amount by which the buffer arm 12 is swingingly displaced decreases, and thus the knitting yarn 7 that has been pulled out of the path is returned to the path.

In this manner, an amount by which the buffer arm 12 is swingingly displaced corresponds to the tensile force of the knitting yarn 7. The sensor 15 detects swinging displacement of the buffer arm 12, using as a reference the origin that is the position of the frontal end side when the knitting yarn 7 is pulled out of the path only by the predetermined length, and a signal indicating the detection result is input to the control means. The control means performs control based on a signal indicating the knitting data of the knitting fabric 2 with respect to a course that is to be knitted by moving the carriage 4, a signal for controlling the carriage, and the signal from the sensor 15. The control means performs PI control on the servomotor 22 of the yarn feeding means 16 such that swinging displacement of the buffer arm 12 follows a target state that is set in advance based on the positional relationship between the carriage 4 and the knitting fabric 2, and thus control for keeping the tensile force of the knitting yarn constant can be realized by actively sending the yarn.

When the carriage 4 rapidly moves in a direction in which the path on which the knitting yarn is fed to the carrier 5 that is brought by the carriage 4 becomes long, the demand for the knitting yarn 7 drastically increases. The drastic increase in the demand for the knitting yarn 7 can be easily predicted based on the signal for controlling the carriage 4. In accordance with the prediction, the control means increases an amount of the knitting yarn by which the knitting yarn 7 is sent out, before the demand for the yarn increases, such that a shortage of the knitting yarn 7 does not occur. Thus, it is possible to sufficiently cope with the drastic demand for the knitting yarn 7.

The control means performs control in accordance with the distance of the path on which the knitting yarn 7 is fed to the carrier 5, the distance from the carrier 5 to the knitting fabric 2, and the control state of the carriage 4, when the carrier 5 is out of the knitting end of the knitting fabric 2. The control means performs control such that actuation of the slack reducing means is stopped when a shortage of the knitting yarn 7 occurs on the feeding path as the carriage 4 moves, and the slack of the knitting yarn 7 is absorbed by actuating the slack reducing means when the knitting yarn 7 becomes excessive on the feeding path as the carriage 4 moves. In this manner, the control means can prevent the knitting yarn 7 from coming loose, in accordance with a drastic fluctuation in the demand for the knitting yarn 7. Especially when protective gloves and others are knitted using, as the knitting yarn 7, a reinforced yarn including metal having a high strength or synthetic fiber, the hardness of the knitting yarn 7 is high and thus the excessive knitting yarn 7 is pushed back, but it is possible to knit the knitting fabric 2 of a high quality by promptly absorbing the excess amount of the knitting yarn 7 with the slack reducing means.

In a case where tension of, for example, a spring material is applied to the feeding path of a knitting yarn as in JP-A 57-191352, it is necessary to increase the tension of the spring material in order to increase the responsibility. In embodiments of the invention, at the end of the knitting fabric, it is possible to reliably pull in the slack that has been generated in accordance with the position of the carriage. It is possible to perform knitting without generating the slack even with a hard yarn such as the reinforced yarn including a wire of a high strength or other materials, and a yarn such as a decorative fuzzy fancy yarn in which the frictional resistance is large and thus the yarn does not slide smoothly, in addition to a knitting yarn made of wool or cotton that is generally used for a sweater or gloves. It is not necessary to increase the tension of the spring material in order to reduce the slack, and thus knitting can be performed without burdening the knitting machine.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

INDUSTRIAL APPLICABILITY

According to the invention, when the movement direction of a carriage is reversed at the knitting end of a knitting fabric, excess amount calculating means calculates an excess amount of a knitting yarn that is generated in the knitting yarn on the feeding path, in accordance with the position of the carrier. The control means performs control such that the slack of the knitting yarn generated due to the excess amount is absorbed by actuating slack reducing means, and thus it is possible to reliably absorb the slack of the knitting yarn changing in accordance with the position of the carrier.

Furthermore, according to the invention, yarn feeding means sends out the knitting yarn by holding the knitting yarn between a plurality of rollers including a yarn feeding roller that is rotatively driven by a servomotor. The control means can control the sending out of the knitting yarn by controlling the servomotor. An amount of the knitting yarn by which a buffer arm is swingingly displaced corresponds to the tensile force of the knitting yarn. The amount of the knitting yarn by which the buffer arm is swingingly displaced is detected by a sensor using the origin as a reference, and a signal indicating the detection result is input to the control means, so that it is possible to suppress the range in which the tensile force of the knitting yarn fluctuates, by controlling the sending out of the knitting yarn.

Furthermore, according to the invention, it is possible to absorb the slack of the knitting yarn on the feeding path to the carrier, by rotating the yarn feeding roller in reverse. Furthermore, according to the invention, the knitting yarn that is pulled in toward the upstream by the yarn feeding roller rotating in reverse is absorbed by a rewinding arm, and thus it is possible to prevent the knitting yarn from coming loose and moving off the yarn feeding roller.

Furthermore, according to the invention, the slack of the knitting yarn that is generated between the yarn feeding roller and the carrier can be absorbed by actuating the slack reducing means.

Furthermore, according to the invention, the slack reducing means includes a stepping motor, and an arm in which the basal end side is mounted on a rotation axis of the stepping motor and the knitting yarn is inserted through the frontal end side. It is possible to easily perform switching by controlling the stepping motor with the control means such that the slack reducing means is not actuated when the knitting yarn is not pulled in by the arm and the slack reducing means is actuated when the knitting yarn is pulled in by the arm.

Furthermore, according to the invention, the control means performs PI control such that swinging displacement of the buffer arm follows a target state that is set in advance based on the positional relationship between the carriage and the knitting fabric, and thus it is possible to feed the knitting yarn in accordance with the target state. When control is performed such that the slack of the knitting yarn is absorbed by actuating the slack reducing means, the origin position that serves as a reference for the swinging displacement of the buffer arm is changed, and thus it is possible to eliminate the slack also using the buffer arm effectively.

The invention claimed is:

1. A yarn feeding apparatus, of a weft knitting machine, for feeding a knitting yarn to a knitting fabric via a carrier that is brought by a carriage in the weft knitting machine in which a knitting fabric is knitted while moving the carriage back and forth in a longitudinal direction of a needle bed, comprising:

slack reducing means that is provided on a feeding path of the knitting yarn, whose actuation state can be controlled, and that can eliminate slack of the knitting yarn in an actuated state by pulling in the knitting yarn within a predetermined range;

excess amount calculating means for calculating an excess amount of the knitting yarn that is generated in the knitting yarn on the feeding path when a movement direction of the carriage is reversed at a knitting end of the knitting fabric, based on a signal indicating knitting data of the knitting fabric with respect to a course that is to be knitted by moving the carriage and a signal for controlling the carriage, in accordance with a distance of the path on which the knitting yarn is fed to the carrier, a distance from the carrier to the knitting fabric, and a control state of the carriage; and control means for performing control such that slack of the knitting yarn is absorbed by actuating the slack reducing means in accordance with the excess amount that is calculated by the excess amount calculating means.

2. The yarn feeding apparatus of claim 1, further comprising:

yarn feeding means that is provided on the feeding path of the knitting yarn, and that sends out the knitting yarn by holding the knitting yarn between a plurality of rollers including a yarn feeding roller that is rotatively driven by a servomotor;

a buffer arm that is provided on the path on which the knitting yarn is fed from the yarn feeding means to the carrier, that can be swingingly displaced around a basal end side, and that is biased by a spring such that a frontal end side through which the knitting yarn is inserted is swingingly displaced and partially pulls the knitting yarn out of the path; and a sensor for detecting swinging displacement of the buffer arm, using as a reference an origin that is a position of the frontal end side when the knitting yarn is pulled out of the path only by the predetermined length, and for deriving a signal indicating a detection result, wherein the control means controls the servomotor of the yarn feeding means such that the knitting yarn that becomes necessary as the knitting fabric is knitted is sent out from the yarn feeding roller, based on the signal indicating the knitting data of the knitting fabric with respect to the course that is to be knitted by moving the carriage, the signal for controlling the carriage, and the signal from the sensor.

3. The yarn feeding apparatus of claim 2, wherein the control means actuates the yarn feeding means as the slack reducing means by performing control such that the yarn feeding roller of the yarn feeding means is rotated in a direction opposite to a direction in which the knitting yarn is sent out.

4. The yarn feeding apparatus of claim 3, wherein the path on which the knitting yarn is fed to the yarn feeding means is provided with a rewinding arm that can be swingingly displaced around a basal end side, that is biased by a spring such that a frontal end side through which the knitting yarn is inserted is swingingly displaced and partially pulls the knitting yarn out of the path, and that absorbs the knitting yarn that has been rewound to the path by rotating the yarn feeding roller in reverse.

5. The yarn feeding apparatus of claim 2, wherein:

the slack reducing means is provided on the path on which the knitting yarn is fed from the yarn feeding means to the carrier, and the control means performs control such that the yarn feeding roller of the yarn feeding means is stopped before the slack reducing means is actuated.

6. The yarn feeding apparatus of claim 5, wherein the slack reducing means includes:

a stepping motor that is controlled by the control means, and an arm having a basal end side mounted on a rotation axis of the stepping motor and a frontal end side through which the knitting yarn is inserted.

7. The yarn feeding apparatus of claim 2, wherein the control means:

performs PI control on the servomotor of the yarn feeding means such that swinging displacement state of the buffer arm follows a target state that is set in advance based on positional relationship between the carriage and the knitting fabric, and changes an origin position that serves as a reference for a swinging displacement of the buffer arm when control is performed such that slack of the knitting yarn is absorbed by actuating the slack reducing means.

* * * * *